US008241188B2

(12) United States Patent
Robinson

(10) Patent No.: US 8,241,188 B2
(45) Date of Patent: Aug. 14, 2012

(54) EXERCISE APPARATUS

(75) Inventor: Brian Robinson, Sutton (CA)

(73) Assignee: 9185-7714 Quebec Inc., Sutton, Quebec (CA)

( * ) Notice: Subject to any disclaimer, the term of this patent is extended or adjusted under 35 U.S.C. 154(b) by 105 days.

(21) Appl. No.: 12/526,847

(22) PCT Filed: Feb. 13, 2008

(86) PCT No.: PCT/IB2008/000871

§ 371 (c)(1), (2), (4) Date: May 14, 2010

(87) PCT Pub. No.: WO2008/104887

PCT Pub. Date: Sep. 4, 2008

(65) Prior Publication Data

US 2010/0240498 A1 Sep. 23, 2010

(30) Foreign Application Priority Data

Feb. 13, 2007 (CA) ..... 2578673

(51) Int. Cl.
*A63B 22/02* (2006.01)
*A63B 69/34* (2006.01)

(52) U.S. Cl. ..... 482/54; 473/441

(58) Field of Classification Search ..... 482/51, 482/54, 148; 473/441, 444; 434/251
See application file for complete search history.

(56) References Cited

U.S. PATENT DOCUMENTS

| | | | | |
|---|---|---|---|---|
| 4,534,557 | A * | 8/1985 | Bigelow et al. | 473/442 |
| 4,890,495 | A * | 1/1990 | Slane | 73/379.06 |
| 5,152,733 | A * | 10/1992 | Farenholtz et al. | 482/135 |
| 5,474,290 | A * | 12/1995 | Rascona et al. | 473/441 |
| 5,655,997 | A * | 8/1997 | Greenberg et al. | 482/5 |
| 5,785,632 | A * | 7/1998 | Greenberg et al. | 482/5 |
| 6,093,119 | A * | 7/2000 | Tipton | 473/438 |
| 6,387,015 | B1 * | 5/2002 | Watson | 482/54 |
| 6,454,679 | B1 * | 9/2002 | Radow | 482/4 |
| 7,736,248 | B2 * | 6/2010 | Eldridge | 473/445 |
| 7,909,749 | B2 * | 3/2011 | Sheedy | 482/148 |

* cited by examiner

*Primary Examiner* — Stephen Crow
(74) *Attorney, Agent, or Firm* — Norton Rose Canada LLP

(57) ABSTRACT

An exercise apparatus is implemented with a frame with a horizontal and vertical component and a rotatable endless belt mounted on the horizontal frame component, the belt having a surface for supporting a user. Vertical frame component has an upper body engaging element connected thereto and adapted to engage the shoulders of a user during a portion of an exercise cycle. An actuator is disposed between the upper body engaging element and the vertical frame component, wherein an increase in actuator length raises the height of the upper body engaging element relative to the belt. The upper body engaging element is positioned at a start position of low height to engage the user in a low-level position at a beginning of the exercise cycle, and the upper body engaging element increases in height as the user accelerates and rises to a fully upright position.

15 Claims, 4 Drawing Sheets

EXERCISE APPARATUS

BACKGROUND

The present disclosure relates to exercise equipment.

FIELD

The benefits of regular exercise have long been recognized, but the demands of today's hectic lifestyle often prevent many individuals from engaging in physical activity. Lack of exercise has been identified as one reason for health problems that are a modern-day epidemic, such as obesity and diabetes.

Regular endurance training induces physiologic changes that improve exercise performance and physical well-being by increasing the body's capacity to transport and utilize oxygen. Brief bouts of high-intensity exercise, on the other hand, are generally thought to have less of an effect on aerobic energy metabolism. However, a growing body of evidence suggests that low-volume, high-intensity interval training (HIT) may represent a time-efficient strategy to reap health benefits normally associated with endurance training.

Interval training is a method used by athletes to develop speed and endurance, but this type of intense training is not often utilized in typical exercise devices. Known exercise machines provide either cardiovascular or resistance training, with some offering elements of both. For instance, U.S. Pat. No. 7,063,647 and U.S. Pat. No. 6,093,119 are directed to treadmill-type devices that offer some resistance training benefits, either by providing a target for the user to strike at one end the treadmill, or a resistance band to be placed around the waist of the user while running. Unfortunately, training benefits of prior art devices are limited, and fail to provide the benefits of high intensity exercise.

Thus, there is a need in the art for an exercise apparatus that provides intense cardiovascular and resistance training, and can be formatted for interval training, to achieve an effective total-body workout and associated health benefits in a short amount of time.

SUMMARY

Implementations are directed to an exercise apparatus having frame with horizontal and vertical frame components. A rotatable endless belt is mounted on the horizontal frame component, the belt having a surface for supporting a user. An upper body engaging element connected to the vertical frame component is adapted to engage the shoulders of a user during at least a portion of an exercise cycle. An extendable actuator is disposed between the upper body engaging element and the vertical frame component, such that an increase in actuator length raises the height of the upper body engaging element relative to the belt. The upper body engaging element is positioned at a start position of low height to engage the user in a low-level position at a beginning of the exercise cycle, and the upper body engaging element increases in height as the user accelerates and rises to a fully upright position.

The upper body engaging element can be pivotably connected to an arm that is disposed between the upper body engaging element and the vertical frame component, so that the upper body engaging element is able to rotate about the pivotable connection. This pivotable connection enables adaptation of the upper body engaging element to the user's changing position throughout use of the apparatus. In accordance with one implementation, the upper body engaging element is a pair of shoulder pads.

The exercise apparatus can also include a stop pad connected to the arm for restricting the rotational movement of the upper body engaging element about the pivotable connection. The arm can further include telescopic tubing along its length, and a gas spring inside the tubing with a mechanical stop. The spring is able to control extension and compression of the arm and absorb any shock produced by engagement of the user with the upper body engaging element during exercise. Preferably, the arm is pivotably connected to the vertical frame component, such that the arm rotates, causing the upper body engaging element to move upwardly or downwardly relative to the belt. In one implementation, a manual force imparted by the user drives the belt.

The exercise apparatus can also include a sensor to detect rotation of the belt, and a computer to count the number of belt rotations and control movement of the actuator based on the number of belt rotations. The computer can further be programmed to signal the actuator to increase the height of the upper body engaging element as the speed of the belt rotation increases. Additionally, the computer can instruct the apparatus to conduct a sprint cycle and a walk cycle. After the user completes the sprint cycle, the computer instructs the actuator to return the upper body engaging element to the start position as the user enters the walk cycle.

In one implementation, the computer instructs the actuator to position the upper body engaging element at a position suited for engaging the user's shoulders throughout the sprint and walk cycles. The computer is also able to adjust the duration of the sprint, walk, and exercise cycles to meet the fitness goals of the user. Additionally, the exercise apparatus can further include a resistance mechanism to add resistance to the belt.

In another implementation, the exercise apparatus includes a programming element to allow a user to choose an exercise protocol to suit the user's training goals. The exercise can include an individual performance measurement that measures the performance of the user during the exercise cycle. Further, the computer is capable of controlling the sprint and walk cycles to create an exercise regimen that requires the user to operate at 85-90% of the user's maximum capacity.

In another implementation, the relative position of the upper body engaging element is substantially independent of impact force exerted upon the upper body engaging element by the user. Further, the position of the upper body engaging element can be adjustable while the apparatus is in use. Additionally, the position of the upper body engaging element can be a function of the exercise cycle and correspond to the speed of the user.

DETAILED DESCRIPTION

Implementations are discussed in detail below. In describing these implementations, specific terminology is employed for the sake of clarity. However, the invention is not intended to be limited to the specific terminology so selected. While specific exemplary implementations are discussed, it should be understood that this is done for illustration purposes only. A person skilled in the relevant art will recognize that other components and configurations can be used without parting from the spirit and scope of the invention.

Figure 1:
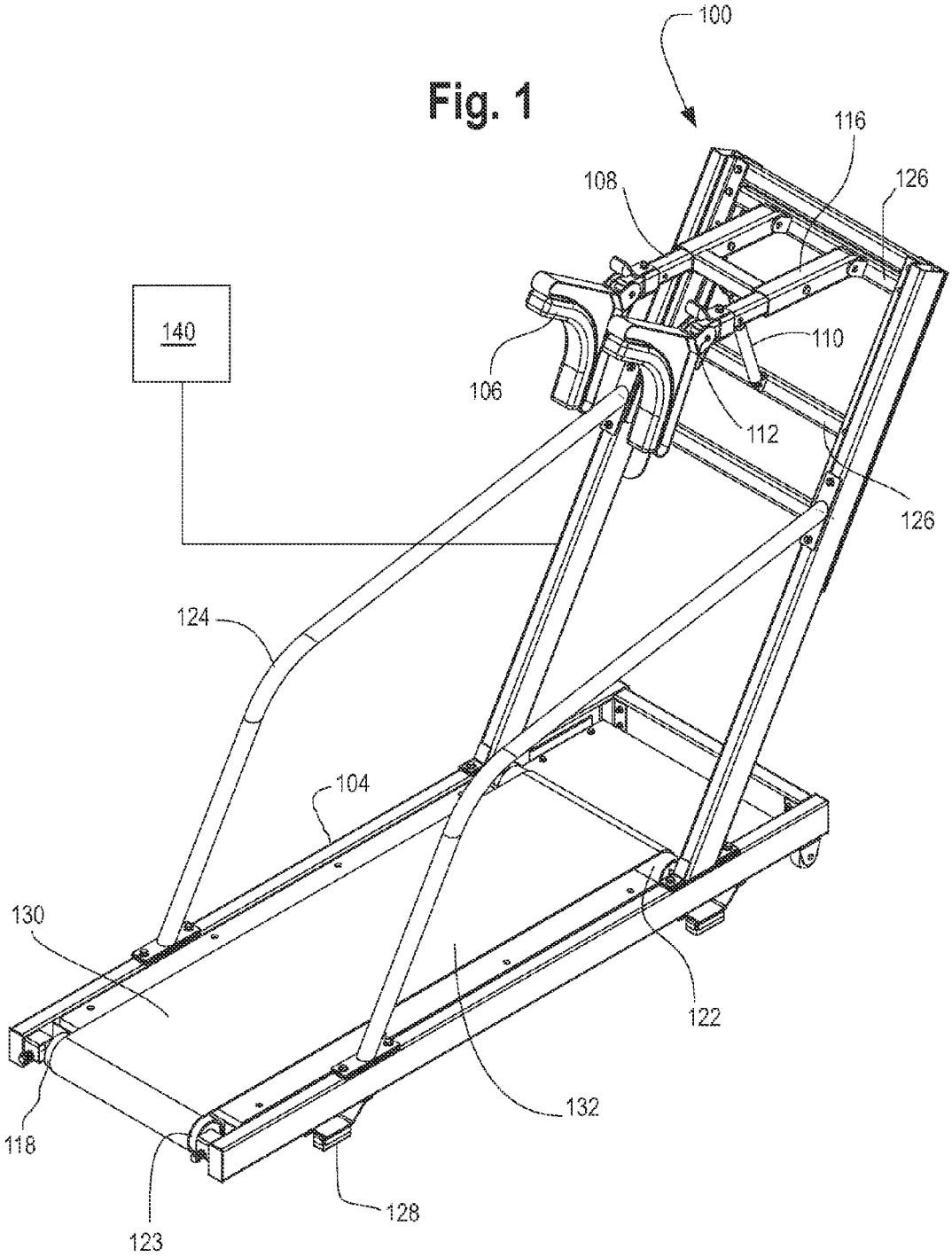
FIG. 1 is a front perspective view of the exercise apparatus according to one implementation.

Referring to FIG. 1, the apparatus 100 has a horizontal frame component 104 and a vertical frame component 102. The horizontal frame component 104 has a rotatable endless belt 130 with upward-facing surface 132 for supporting a user, Belt 130 extends between two substantially parallel rollers: front roller 122 and back roller 123, either of which can include a sensor 118 to detect the number of rotations of the endless belt. Belt surface 132 runs on top of an opposing horizontal surface (not shown) associated with horizontal frame component 104. Disposed on the bottom side of the horizontal frame component 104 are feet 128, to support and provide stability to the apparatus 100. The belt may also travel on a friction reduced surface of bearings or the like.

The vertical frame component 102 is connected to the horizontal frame component 104 and is substantially upright. Vertical frame component 102 has arms 108 attached thereto. The connection where arms 108 meet vertical frame component 102 is preferably a pivotable connection, permitting a swivel movement, such that the arms can move about the connection point. Thus, the arms 108 can rise in height (relative to the belt), increasing the angle between the arms 108 and the vertical frame component 102, and lower in height as the angle between the arms 108 and the vertical frame component 102 decreases. The arms 108 extend away from the vertical frame component 102 towards an upper body engaging element 106. The upper body engaging element 106 is adapted to engage the upper body of a user, and can provide an opposing element against which the user works when propelling him or herself in a forward motion. In the illustrated Figures, the upper body engaging element is depicted as shoulder pads 106, adapted to engage shoulders of a user. Preferably, the shoulder pads 106 are also connected to the arms at respective pivotable connections 112, and the range of motion of the upper body engaging element 106 about this connection 112 can be restricted by stop pads 114. The ability of the shoulder pads 106 to swivel allows for better engagement of a user's shoulders throughout the exercise cycle as the user's position changes. Other implementations having different shaped elements for engaging the upper body, and different connections from those discussed above, are also possible.

Figure 3:
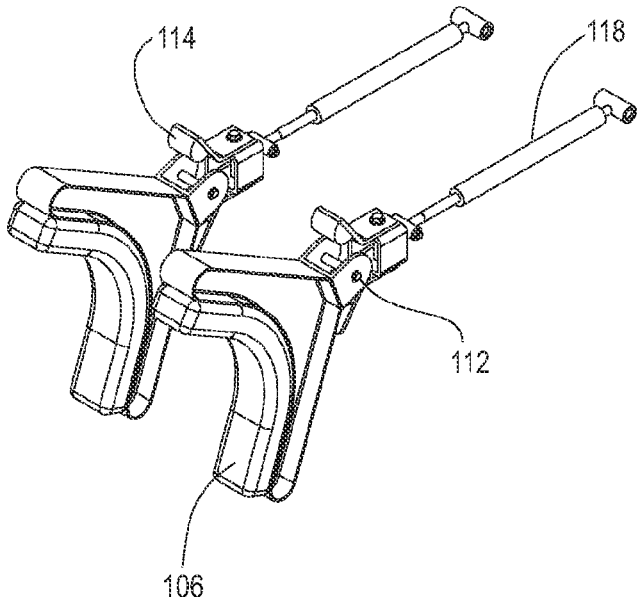
FIG. 3 is an elevated view of the arms and upper body engaging element according to implementation.
Figure 4:
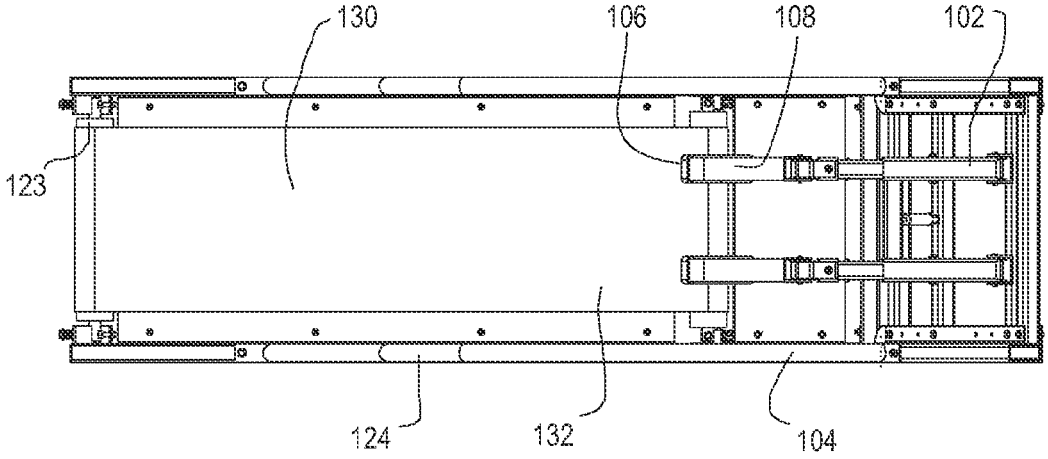
FIG. 4 is a top view of the apparatus according to one implementation.

Telescopic tubing 116 can be present along arms 108, each tubing having a gas spring 136 fixed inside (see FIG. 3). Spring 136 allows for compression and extension of the arms 108, acting as a shock absorber from pressure received by the user during engagement. A mechanical stop (not shown) can be present to limit both the compression and extension of the arms 108.

Figure 2:
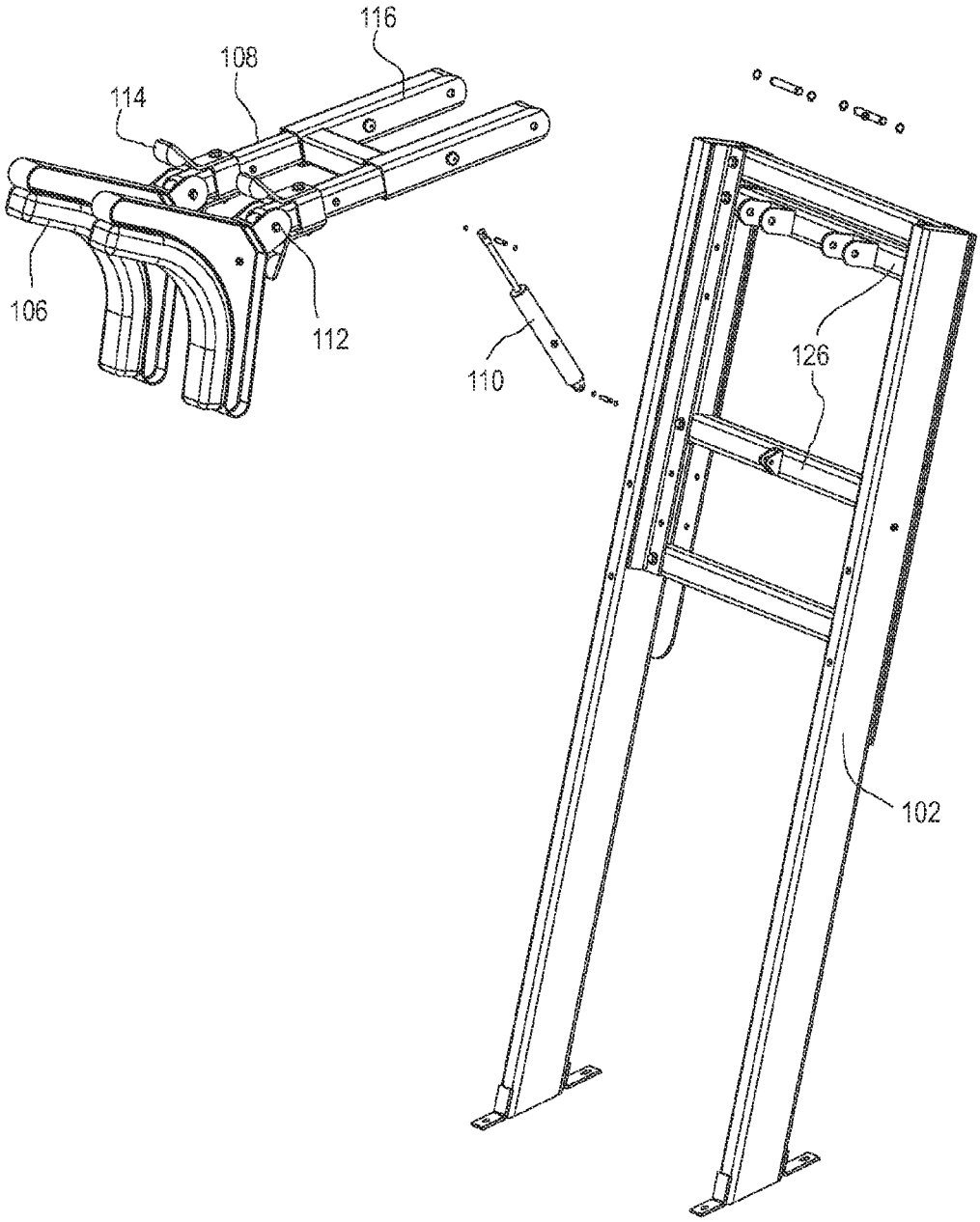
FIG. 2 is a side view of the upper body engaging element, arms, and frame of the apparatus according to one implementation.

In order to move the arms during the exercise cycle, the apparatus can include an extendable actuator 110. In the implementation shown in FIGS. 1 and 2, the actuator is located between arms 108 and bar 126 on the vertical frame component 103. As the actuator 110 extends, the angle of the arms 108 relative to the vertical frame component 102 increases, such that the shoulder pads 106 move in an upwards motion, away from the vertical frame component 102. To decrease the angle of the arms 108 and shoulder pads 106 relative to the vertical frame component 102, the actuator 110 retracts in a controlled fashion, to prevent a sharp drop in position of the shoulder pads. Thus, the actuator is able to adjust the height of the upper body engaging element. In one implementation, the actuator 110 can have an eight-inch travel, meaning that the actuator has an adjustment of eight inches. In this implementation, the length of the actuator 110 when fully extended is about 16 inches. When the actuator 110 is not extended, its length is about 8 inches.

Positioning of the arms 108 along the vertical frame component 102 can be adjusted to fit the height of user. For example, bar 126 to which arms 108 are affixed, can be moved along the vertical component 102 and locked into place using a pin.

To begin use of the machine, the user assumes a position that is low to the ground, engaging shoulder pads 106, and with hands either on handrail 124 or at the user's sides. Preferred apparatus embodiments are not motorized, so that the user alone powers the belt 130. However, embodiments utilizing a motor are within the scope of the invention. As the user increases speed, the user rises from the low-level position, and the shoulder pads 106 rise with the user, so that the user is running against the shoulder pads 106 throughout the anaerobic or sprint cycle. Once the user achieves a full sprint, he or she is in a fully upright position. At this point, the shoulder pads 106 can release and lower for the recovery period. For example, the shoulder pads 106 can lower to the position at which the user originally engaged the pads, the starting low-level position. The user can engage the pads 106 at this lower position, creating target resistance and greater work throughout the abdominals. Alternatively, the shoulder pads 106 can be maintained at the higher position for the recovery period. The choice of position depends upon the preference and fitness goals of the user. Still further exercise protocols are contemplated.

In one implementation, the apparatus trains a user through anaerobic and aerobic cycles. The anaerobic cycle can simulate a sprint, and the aerobic cycle can be a recovery period, such as walking. Accordingly, a complete exercise cycle includes, for example, at least one a sprint cycle and at least one walk cycle. Use of the machine can also include repeated alternating cycles, or intervals, of each. The duration of the sprinting and walking cycles can be about 10 seconds each, and the complete exercise cycle can be about 60-90 seconds. Because a user can be trained at up to 85-90% of his or her total capacity (e.g., 85-90% of maximum heart rate), a complete total body workout can be achieved in about 1-5 minutes, depending on the fitness of the user.

In one implementation, the apparatus 100 includes or is adaptable for connection to a computer 140. The computer 140 can be suitably programmed for any number of applications, including training regimens, exercise protocols, and the like. Thus, for example, the use of the aerobic and anaerobic cycles discussed above can be suitably computer implemented. In further examples, the computer can provide for a steady-state exercise routine that can build endurance, or a routine that becomes progressively more or less physically taxing.

In still another implementation protocol, based upon the speed of the user measured by the number of belt rotations completed per unit of time, the computer 140 will signal the actuator 110 to adjust its length. For example, as the rate of belt rotations increases (and the user is increasing speed), the actuator 110 will extend so that the arms 108 and shoulder pads 106 rise with the user. The computer 140 can detect movement of the belt 130 through a sensor, such as an infrared sensor 118 present on either side of rollers 122 or 123. In one implementation, the sensor 118 is on front roller 122. Computer 140 may count revolutions to determine how to position the arms 108 and shoulder pads 106 relative to the user, such position being, for example, dependent on the number of belt rotations. Computer 140 thus signals the actuator 110. Thus, the position of the shoulder pads 106 is a function of the exercise cycle, and can be dependent on and determined by the speed of the user.

In one possible variation, once the user has achieved a full sprint (detected by speed or number of revolutions), the computer 140, after a predetermined amount of time, signals the actuator 110 to decrease in length, and lower to a predetermined position for a walk or rest cycle. Alternatively, the shoulder pads 106 can be maintained higher (upright sprint position) for the recovery period. In this implementation, the positioning of the shoulder pads 106 during the recovery period is dependent on the protocol or program chosen by the user.

The computer 140 can include a programming feature, allowing the user to choose between, for example, a high interval training program or a performance measurement. A performance measurement helps the user determine his performance compared to previous performance, or to that of another individual. This measurement can be determined by power output, such as the number of revolutions of the belt 130 over a certain period of time (e.g., 30 seconds), or individual performance for a set criteria, such as a 40 yard dash or 100 meter sprint.

In certain implementations, the programming feature of computer 140 includes a program algorithm that can determine the position of shoulder pads 106. The algorithm can be based on a standard curve that simulates the physical challenge on a sprinter during an actual sprint, simulates the movement of a sprinter during an actual sprint, and/or makes further modifications to enhance training as desired. For example, the lower positioning of the shoulder pads 106 during the beginning of a sprint cycle exaggerates the user's forward position so that the user is trained to keep a forward-directed momentum. When starting in the low-level position, the effort to continue forward motion trains and builds core muscles, in part due to the user trying to maintain his balance while propelling himself forward in this low position. If the cycle is set for a 100 meter sprint, the user's body can be in this forward thrust position for about 25 meters, and then begin to rise, hitting optimum height at about 75 meters. Depending on the protocol of the exercise cycle, these numbers can be altered, according to the type and level of training that is desired, and the level of fitness of the individual.

Figure 5:
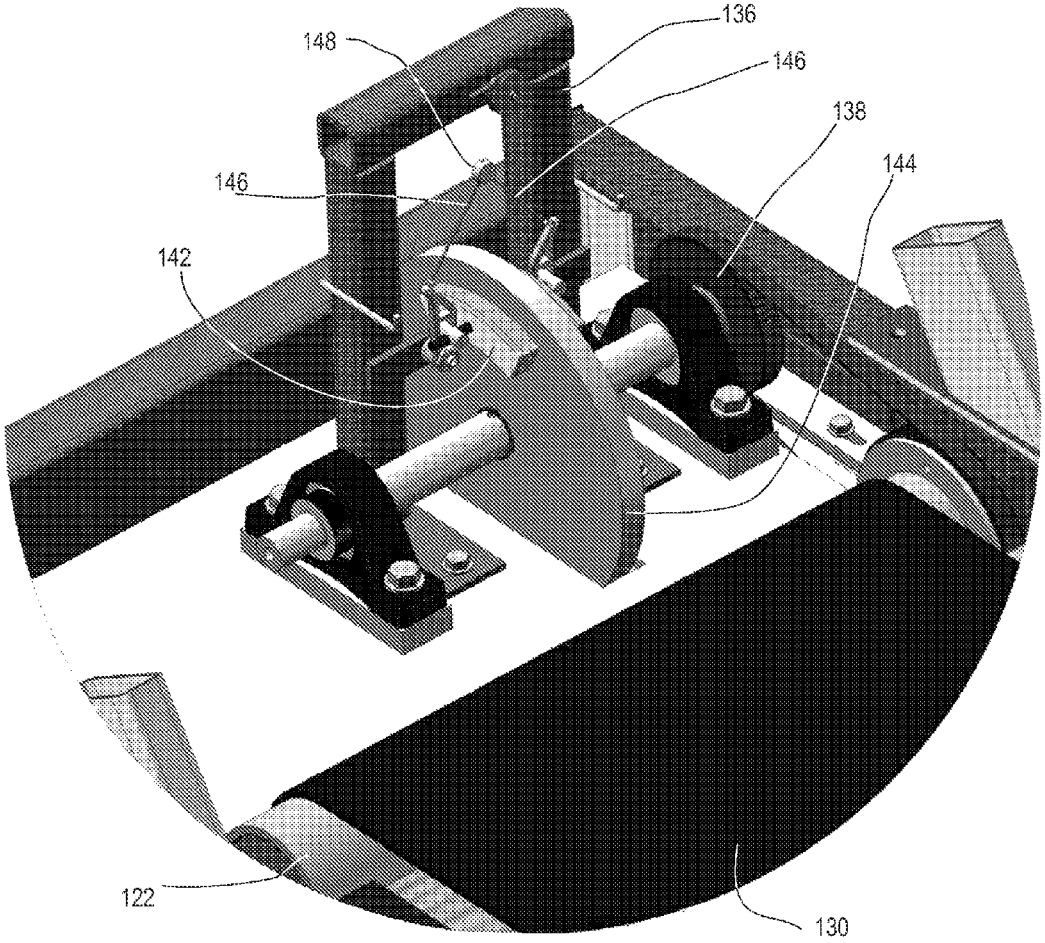
FIG. 5 is a perspective view of a belt resistance mechanism according to one implementation.

Implementations of the invention can also incorporate resistance into the belt 130, to increase the level of training. For example, a resistance that is equal to 7.5 percent of the user's body weight can be added to the belt for an average user, or a resistance of 10% can be added for a highly trained individual. In one implementation that is illustrated in FIG. 5, the resistance includes a braking mechanism 136 connected to front roller 122. In one implementation, braking mechanism 136 interacts with front roller 122 via belt and pulley system 138. When a runner is on the belt 130, movement of the belt 130 induces rotation of the front roller 122. This movement is transferred via the belt and pulley system 138 to the braking mechanism 136. Braking mechanism 136 includes brake pads 142 on either side of brake wheel 144, wire bracket connected to brake pads 142, and top pulley 148, connected to wire bracket 146. Movement of top pulley 148 pulls wire bracket 146 upwardly, which results in brake pads 142 compressing on brake wheel 144. Alternatively, a manual adjustment such as a twist handle (not shown) can be connected to top pulley 146, such that rotation of the handle displaces the wire bracket 146 to increase or decrease resistance. In yet a further implementation, the apparatus can include a lever that can be hand-operated by user to adjust the resistance. The lever (not shown) can be located along vertical frame component 102, on either side of the upper body engaging element.

In another implementation, the resistance can be an electronic/programmable mechanical system, or an electromagnetic braking system. In an additional implementation, actuators (not shown) can be used to apply lateral force to the brake pads 142. The actuators can be controlled by a control box that can measure the applied force through sensors.

This belt resistance provided by the apparatus can be from 0-99% of the total resistance provided by the machine to a user. The belt resistance can be used to simulate a hill and increase the challenge on the user's leg muscles, as well as the overall cardiovascular and strength challenge. When training a football player, such as a defensive lineman or running back, the resistance of the belt 130 can be increased by a greater percentage, to simulate blocking a player or running against the pulling force of other players.

Further implementations may vary the form of the endless belt 130 or provide non-belt alternatives suitable to engage and challenge lower body muscles. For example, a sliding track with footpad(s) for forward and reverse motion, pedals for elliptical or cyclical motion, or pedals for simulating a stepping motion can be used. Another implementation can include a split belt system, such that each foot has its own belt, in order to test or train the ability or strength of one foot independently from the other foot. In this implementation, there can be two sensors to detect movement of each belt, as well as two resistance/braking mechanisms. Yet another implementation includes variations on the style of shoulder pads. For example, the shape of the shoulder pads can be adjusted so that a runner can engage them while running backwards, to train in reverse motion, or while running sideways, for lateral training.

When using implementations of the apparatus that implement a training regimen of intervals, the duration of the intervals can be altered to suit the individual's needs and level of fitness. For example, when the exercise apparatus 100 is used to increase performance for a particular sport, or a particular position or role in a sport, the duration of the anaerobic and aerobic cycles can be altered accordingly. For example, the work (sprint) to rest (walk) ratio could be 45 seconds work to 1 minute rest, or 10 seconds work to 20 seconds rest. Alternatively, the durations of each cycle can continually change throughout the workout, such as 30 seconds work to 30 seconds rest, followed by 20 seconds work to 15 seconds rest, and so on.

By altering the various features (e.g., belt resistance, timing of intervals, positioning of shoulder pads), a user is able to achieve a workout that pushes or trains the user at his or her maximum ability each time. Through the use of standardized measurements, the user is also able to quantifiably measure performance. Continual engagement of the shoulder pads, coupled with resistance on the belt and interval time that is optimized to a user's needs, pushes a user to train at his or her maximum capacity. This intense training, utilizing resistance primarily on the legs and core muscles, increases fat burning as well as strength development. Because the workout is so demanding, performance improvement is seen much more quickly than with standard training methods. The ability to utilize protocols and personalize the workout, and to produce a quantifiable performance measurement, further increases the ability to train effectively.

On a molecular level, the intensive exercise performed using the apparatus of the present invention increases access to immediate energy sources (phosphor-creatine) and access to oxygen supplies for increased performance, speed and endurance. High-intensity training also decreases recovery time by stimulating replacement of intracellular energy sources and increasing the transport of lactic acid and other toxins from the muscles into the blood stream. The overall effect is an increased athletic performance.

The implementations illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. For instance, the upper body engaging element may take a different shape or be replaced with another type of opposing force, the belt can be split or replaced with other devices that engage the muscles of the legs, or the mechanisms for altering the positioning of the user throughout the exercise cycle can be altered, to achieve the exercise activity and fitness goals set forth herein. It is therefore to be understood that, within the scope of the claims and their equivalents, the invention may be practiced otherwise than as specifically described.

What is claimed is:

1. An exercise apparatus comprising:

a frame having a horizontal frame component and a vertical frame component;

a rotatable endless belt mounted on the horizontal component, the belt having a surface for supporting a user and driven manually by a force exerted by the user;

an upper body engaging element for engaging the user's upper body during an exercise cycle, the upper body engaging element connected to the vertical frame component by an arm;

a pivotable connection between the vertical frame and the arm, allowing the upper body engaging element to rotate about the pivotable connection and adapt to the user's changing position throughout use of the apparatus;

an actuator of adjustable length disposed between the arm and the vertical frame component, wherein an increase in actuator length raises the height of the upper body engaging element relative to the belt;

a sensor to detect rotation of the belt;

a programmable computer to count a number of belt rotations, measure the performance of individual exercise cycles, and control movement of the actuator using measured parameters, including the number of belt rotations.

2. The apparatus of claim 1, wherein the upper body engaging element is pivotably connected to the arm and the upper body engaging element is able to rotate or swivel about the pivotable connection, enabling adaptation of the upper body engaging element to the user's changing position throughout use of the apparatus.

3. The apparatus of claim 2, further comprising a stop pad connected to the arm for restricting the rotational movement of the upper body engaging element relative to the arm.

4. The apparatus of claim 1, wherein the arm further comprises telescopic tubing along the a length of the arm and a gas spring inside the tubing with a mechanical stop to control extension and compression of the arm and absorb any shock produced by engagement of the user with the upper body engaging element during exercise.

5. The apparatus of claim 1, wherein the computer is programmed to signal the actuator to increase the height of the upper body engaging element as the speed of the belt rotation increases.

6. The apparatus of claim 5, wherein the computer instructs the apparatus to conduct a sprint cycle and a walk cycle, and after the user completes the sprint cycle, the computer instructs the actuator to return the upper body engaging element to the start position as the user enters the walk cycle.

7. The apparatus of claim 6, wherein the computer instructs the actuator to position the upper body engaging element at a position suited for engaging the user's shoulders throughout the sprint and walk cycles.

8. The apparatus of claim 7, wherein the computer adjusts the duration of the sprint, walk, and exercise cycles to meet the fitness goals of the user.

9. The apparatus of claim 1, further comprising a resistance mechanism to add resistance to the belt.

10. The apparatus of claim 5, further comprising a programming element to allow a user to choose an exercise protocol to suit the user's training goals.

11. The apparatus of claim 10, wherein the exercise protocol includes an individual performance measurement that measures the performance of the user during the exercise cycle.

12. The apparatus of claim 6, wherein the computer controls the sprint and walk cycles to create an exercise regimen that requires the user to operate at 85-90% of the user's maximum capacity.

13. The apparatus of claim 1, wherein the upper body engaging element is a pair of shoulder pads.

14. The apparatus of claim 1, wherein the position of the upper body engaging element is a function of the exercise cycle and corresponds to the speed of the user.

15. The exercise apparatus of claim 1 wherein the upper body engaging element is positioned at a start position of low height to engage the user in a low-level position at a beginning of the exercise cycle, and the upper body engaging element increases in height as the user accelerates and rises to a fully upright position.

* * * * *